United States Patent [19]

Dárán et al.

[11] 3,945,094

[45] Mar. 23, 1976

[54] SYSTEM FOR THE INHUMATION OF CORPSES

[76] Inventors: Jose Luis Dávila Dárán; Mario C. Zamorano Sánchez, both of Lopez 15-503, Mexico City, 1; Antonio Ovando Hernández, Insurgentes Sur 1824 3er Piso, Mexico City, 20, all of Mexico

[22] Filed: Dec. 5, 1974

[21] Appl. No.: 530,027

[52] U.S. Cl. ..... 27/11; 52/129; 52/134

[51] Int. Cl.[2] ..... E04H 13/00

[58] Field of Search ..... 52/134, 128, 131, 133, 52/139, 132, 2, 136, 142, 138, 79, 236; 27/1, 11, 19; 150/1, 1.5; 285/200

[56] References Cited

UNITED STATES PATENTS

| | | | |
|---|---|---|---|
| 131,668 | 9/1872 | Curran | 27/11 |
| 311,764 | 2/1885 | Johnson | 27/11 |
| 1,115,284 | 10/1914 | Collett | 52/132 |
| 2,677,406 | 5/1954 | Cunningham | 150/1 |
| 3,103,053 | 9/1963 | Hollis | 52/128 |
| 3,295,869 | 1/1967 | Chambers et al. | 285/200 |
| 3,415,299 | 12/1968 | Hinman et al. | 150/1 |
| 3,435,494 | 4/1969 | Bernard | 27/11 |
| 3,564,796 | 2/1971 | Smith | 52/131 |
| 3,820,205 | 6/1974 | Shaw | 27/1 |

*Primary Examiner*—Ernest R. Purser
*Assistant Examiner*—Robert Farber
*Attorney, Agent, or Firm*—Browdy and Neimark

[57] ABSTRACT

An improved system for the inhumation of corpses which comprehends the use in combination of a group of drawers, honeycomb shaped, prefereably of reinforced concrete, waterproof, with calculated foundations and with inclination to unload; a drainage through a plastic tube, or of any other material, connecting to a bag of the same material or any other of another choice, destined to contain hermetically, cadaveric residuals; an access valve to the tube permiting the introduction into same of chemical dissolvent products, with the fundamental purpose of avoiding air contamination; a septic pit acting as final recipient of the drainage tube; an injection valve with direct access to the coffin, that permits the introduction into it of products or chemical elements, disinfectants, disintegrators or dissolvents, in case of premature exhumation or with any other purpose; and a valve or connecting faucet to the tube serving as drainage to isolate every connection with the other drawers, and exterior lids, also on reinforced concrete, hermetical and ornamented on the exterior.

9 Claims, 5 Drawing Figures

Fig. 1.
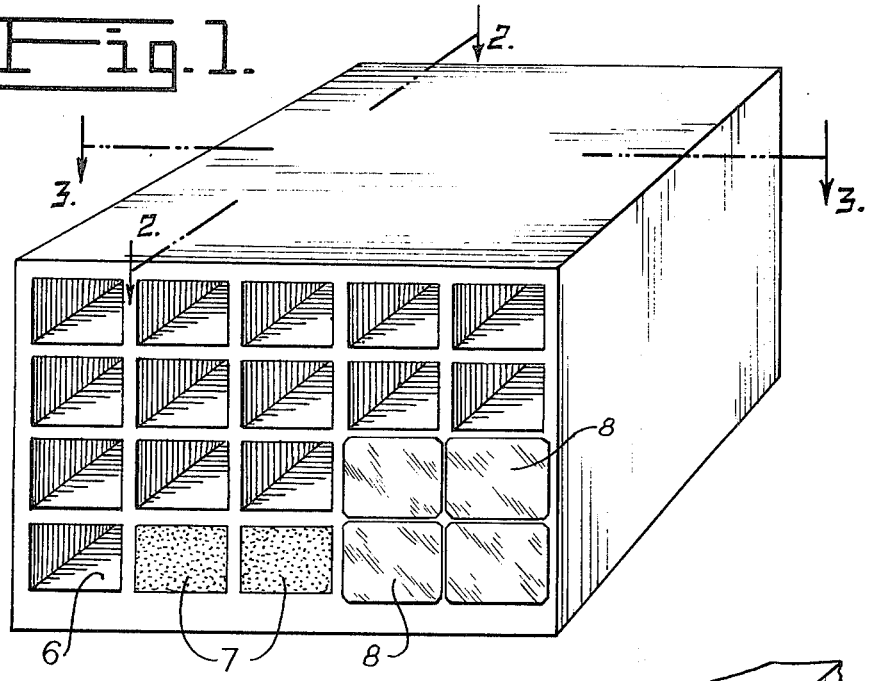
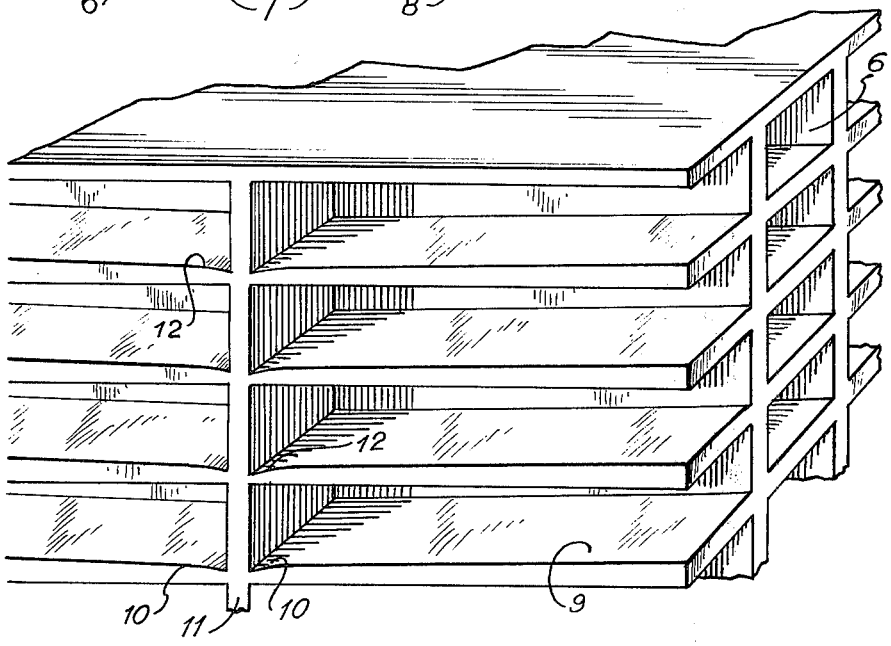
Fig. 2.

SYSTEM FOR THE INHUMATION OF CORPSES

BACKGROUND OF THE INVENTION

1. Field of the Invention

The present invention belongs to the field of enterprises dedicated to the creation of proper elements for the inhumation of corpses and particularly it refers to a structure of drawers advantageously substituting the crypts, tombs or conventional graves eliminating through its use the problems of space, health, air contamination and aesthetics that have affected conventional burial systems.

2. Description of the Prior Art

In ancient pagan times men placed their graves in the open air and in places as visible as roads, that started at the city gates. Christians placed the graves back to the walls of the catacombes, churches and cloisters or placed them in the middle of the chaples or in the crossing of the aisles in the churches.

Even before the time of the above mentioned graves, the Egyptian Pyramids were known and the closed chambers with conic domes of the Greeks that are found in Micenas and Orcomenes.

A variety of the mural graves are the double or superimposed graves that form a single decorative unity, as those to be seen in the chapel of the New Kings, in the Cathedral of Toledo.

The mural graves had their prime within the Middle Ages and dwindled afterwards, due to the ecclesiastic position that considered as burial places exlusively the communal cementeries, whereas the mural graves were reserved to members of the religious orders.

A difference must be established between the concepts relating to the invention of the grave and the hipogeo, because whilst the grave has a commemorative finality and projects the idea of externalizing the memory of the deseased through monuments, the hipogeo has as ultimate destiny the perfection of a concavity in the earth provided by nature, found appropriate by men to bury his dead.

From an architectural point of view, the equivalents of the tombs, graves and mausoleums, are the crypts that form together with the above mentioned graves of the Middle Ages, the real background of the present invention, because while the grave is really a burial cavity effected in the wall, the crypt is an underground cavity, the origin of which is found in the Roman catacombs that, with the evolution of the religious cult, became real underground churches.

Another antecedent to be mentioned is the type of underground grave, typical of the Chaldeans and which is an oblong construction made of superimposed bricks that contain a closed funeral chamber with a vault made of rows and with the inclined walls resting in it. The general dimentions of this type of graves were of 1.52 meters of height by 1.89 meters of width and 2.13 meters of length. Its side walls closed this kind of gallery in which we note the absence of doors, possibly to avoid the entrance of water and dust.

Within the modern era, systems to inhume corpses are known which are characterized by the employment of drawers that use as an entrance, a side opening made on its longer sides, found in the depth of the earth.

Usage of surface drawers is known, having as an entrance an opening made in either of the shorter side zones of said drawers.

Up to the date in which this study was requested to be prepared, no system whatsoever of inhumation is known to employ superimposed drawers upwards and sideways, with internal inclinations and with external drainage to eliminate organic residuals, thus avoiding air contamination.

SUMMARY OF THE INVENTION

The principal object of this invention is to provide a group of rectangular drawers in line, in one block and with an entrance preferably made in the shortest sides, back to back with another similar block, with inclinations of drainage in the internal zones, for the inhumations of human corpses.

Another object of the present invention is to provide a system of drainage to eliminate residuals of inhumated corpses in drawers built in blocks, honeycomb shaped consisting in coupling to a plastic or polyethylene bag or of any other material, and attaching to the inferior side of it, a tube of any of the above mentioned materials with an exit hole destined to eliminate the residuals into a septic pit containing chemical products for the destruction of microbes and organic elements which are the product of corpses residuals.

Another object of this invention is to provide in the inferior extreme of the plastic bag a tube with an injection valve that permits the introduction into the coffin of chemical products, disinfectants, disintegrators or dissolvents in case of premature exhumation or with any other purposes.

Another purpose of this invention is to provide in the drainage tube, destined to discharge the cadaveric residuals, a valve or faucet that isolates all connections with other drawers, allowing its individual functioning.

Another purpose of this invention is to provide an improved system for the inhumation of corpses consisting in providing for a plastic bag, or any other suitable material for containing human residuals, sealed by heat in order to maintain a hermetic seal, connecting in its inferior side with a plastic tube of drainage or any other material to which an extracting valve is coupled to dissolve, being able also to connect it to another tube to which an injection valve is coupled for chemical elements.

An ultimate object of this invention is to provide a system of inhumation that employs a combination of rectangular drawers with internal inclination; a plastic bag hermetically sealed; a plastic tube or of any other material for drainage; an injection valve coupled directly to the coffin and a system of hermetic external sealing, with a decorative superimposed plaque.

These and other objects of the invention may be deducted when the following drawings and descriptions of same are taken into consideration.

BRIEF DESCRIPTION OF THE DRAWINGS

FIG. 1 illustrates a frontal view with conventional perspective of the structure based on drawers which is the object of the present invention.

FIG. 2 shows a lateral view of the structure based on drawers which is the object of the present invention, eliminating the corresponding lid.

DESCRIPTION OF THE PREFERRED EMBODIMENTS

Figure 3:
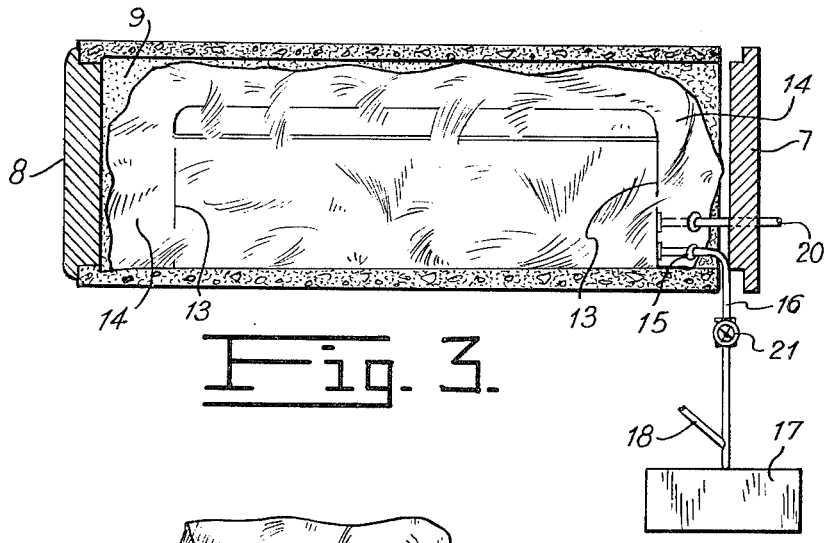
FIG. 3 illustrates a partial sectional view along lines 2—2 of FIG. No. 1, showing the internal disposition of the coffin, of the plastic bag containing it and the tube connected to same.
Figure 4:
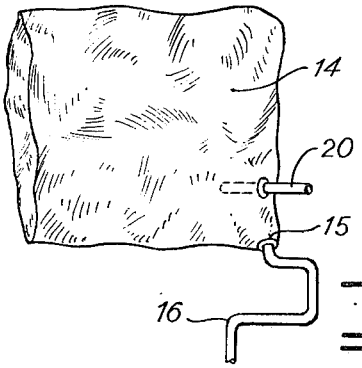
FIG. 4 shows a view in conventional perspective of the inferior portion of the plastic bag, that connects with the tubes of the same material the purpose of which is the drainage and the injection valve.
Figure 5:
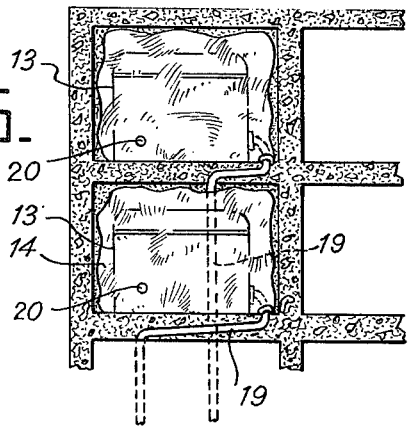
FIG. 5 shows a view in partial sectional view along lines 3—3 of FIG. No. 1, illustrating the preferential disposition of the tubing and its external connections.

Proceeding to an even deeper description of the invention and particularly within FIG. No. 1, number 6 identifies the drawers of concrete, waterproof, in their superimposed positions, vertically and lengthwise, the access of which is covered by a first lid 7 and a second covering in the front part made of durable materials with external decorative finishing 8. Within FIG. No. 2, number 9 identifies the deposit cavities seen laterally, with the internal extremes 10 back to back to a central wall 11 with an inclination relation 12 sloping toward the central wall (11) for drainage purposes. The initial step of the present invention is to introduce the coffin 13 (See FIG. 3) into a plastic bag 14 which is sealed through heat or any other system, guaranteeing a hermetical sealing. At the inferior extreme 15 of the plastic bag (14), a plastic tube 16 is coupled freely descends to a septic pit 17. This coupling is effected through the use of perforable diaphragms and screws. The septic pit 17 contains chemical products therein for destroying microbes and avoiding air contamination. An access valve 18 is coupled to said tubing (16) with the object of allowing the introduction from the outside of chemical products that will produce the dissolution of the tubing with the ultimate end of avoiding air contamination.

The construction of individual tubings for drainage 19 (FIG. No. 5) are being contemplated in order to avoid unnecessary contaminations thay may be produced when withdrawing any of the coffins from the bags in case of using common drainage for the complete structure.

Another characteristic consists in using an injection valve 20 (FIG. No. 3) that permits the introduction into the coffin of chemical elements with the object of disinfecting.

An additional characteristic consists in using a valve or faucet 21 (FIG. No. 3) that isolates the operation of the drainage in each drawer, avoiding thus a possible contamination with the other drawers.

It must be understood that the form, materials and modus operandi employed to illustrate the invention are simple variations of the same, but the innovations that conform it are constant in relation to the other modifications that the experts may conceive in this art based on the described elements.

We claim:

1. An apparatus for the elimination of organic residuals in the inhumation of a plurality of corpse-containing coffins, comprising:

a plurality of vertically arranged drawers, each drawer having an entranceway allowing the coffin to be placed therein, and each drawer having an internal inclination for drainage purposes for eliminating the organic residuals;

a plastic or polyethylene bag completely surrounding and hermetically sealing each of the coffins;

a common septic pit;

a tubing means connected to the interior of each of the coffins and passing through each of said bags for transporting the organic residuals to said septic pit and for isolating the organic residuals contained in every coffin from each other coffin;

a separate injection valve means connected to each of the coffins and passing through said hermetically sealed plastic bag for allowing a chemical composition to be repeatedly introduced to each coffin for the purpose of disinfection and the prevention of air contamination, wherein each of the coffins utilizes a different injection valve means than every other coffin; and hermetically sealed exterior lids for closing the entranceway of each of said drawers when a coffin is introduced therein.

2. An apparatus according to claim 1 wherein said drawers are arranged both vertically and longitudinally.

3. An apparatus according to claim 1 wherein said drawers and said exterior lids are constructed of waterproof, reinforced concrete.

4. An apparatus according to claim 1 wherein said tubing means and said injection valve means are coupled to said plastic bag by perforable diaphragms and screws.

5. An apparatus according to claim 1 wherein said septic pit contains chemicals for destroying microbes and for preventing air contamination.

6. An apparatus according to claim 8 further including an access valve connected to said tubing member for the introduction of chemicals to produce the dissolution of said tubing member.

7. an apparatus according to claim 1 wherein said tubing means comprises a separate tubing member for each coffin.

8. An apparatus according to claim 1 wherein said tubing means comprises a single tubing member connected to all of said coffins for transporting the organic residuals to said septic pit, and a plurality of valve means provided in said tubing member, one of said valve means in association with each of said coffins for isolating the organic residuals contained in every coffin from each other coffin.

9. An apparatus according to claim 7 further including an access valve connected to each of said tubing members for the introduction of chemicals to produce the dissolution of each of said tubing members.

* * * * *